US006336623B1

(12) United States Patent
McCarthy

(10) Patent No.: US 6,336,623 B1
(45) Date of Patent: Jan. 8, 2002

(54) PORTABLE SAFETY BARRIER

(76) Inventor: John J. McCarthy, 13863 Whisperwood Dr., Clearwater, FL (US) 33762

( * ) Notice: Subject to any disclaimer, the term of this patent is extended or adjusted under 35 U.S.C. 154(b) by 0 days.

(21) Appl. No.: 09/643,057

(22) Filed: Aug. 21, 2000

(51) Int. Cl.[7] ..... E04H 17/00

(52) U.S. Cl. ..... 256/64; 256/32; 256/59; 256/DIG. 6; 182/113

(58) Field of Search ..... 256/63, 64–59, 256/65, 36, DIG. 6, 32, 30, 31, 35; 182/113, 45

(56) References Cited

U.S. PATENT DOCUMENTS

| | | | | |
|---|---|---|---|---|
| 458,227 | A | | 8/1891 | Elliott |
| 1,340,273 | A | | 5/1920 | Jones |
| 2,495,972 | A | | 1/1950 | Johnson |
| 2,573,443 | A | | 10/1951 | Holland |
| 3,028,136 | A | | 4/1962 | Vento |
| 3,630,491 | A | * | 12/1971 | Puccio ..... 256/64 |
| 3,708,141 | A | | 1/1973 | Friedgen et al. |
| 3,861,635 | A | | 1/1975 | Juris |
| 3,880,405 | A | * | 4/1975 | Brueske ..... 256/59 |
| 4,183,695 | A | * | 1/1980 | Wilcox ..... 256/1 X |
| 4,666,131 | A | | 5/1987 | Kettelkamp, Sr. et al. |
| 4,787,475 | A | | 11/1988 | Arteau et al. |
| 4,909,483 | A | | 3/1990 | van Herpen |
| 4,979,725 | A | | 12/1990 | Hutchings, II et al. |
| 5,314,167 | A | | 5/1994 | Holloman |
| 5,356,119 | A | * | 10/1994 | Schock ..... 256/26 |
| 5,377,958 | A | * | 1/1995 | Palmer ..... 256/59 |
| 5,379,859 | A | * | 1/1995 | Pigman ..... 182/45 |
| 5,431,372 | A | | 7/1995 | Kostelecky |
| 5,558,312 | A | * | 9/1996 | Brennan ..... 256/65 |
| 5,570,559 | A | * | 11/1996 | Lewis ..... 256/DIG. 6 X |
| 5,573,227 | A | * | 11/1996 | Hemauer et al. ..... 256/65 |
| 5,647,451 | A | | 7/1997 | Reichel |
| 5,711,398 | A | | 1/1998 | Bartholomew |
| 5,718,305 | A | * | 2/1998 | Palmer ..... 182/45 |
| 5,842,685 | A | | 12/1998 | Purvis et al. |
| 5,896,944 | A | * | 4/1999 | McMillian et al. ..... 182/113 X |
| 6,038,829 | A | | 3/2000 | Franks |
| 6,039,150 | A | | 3/2000 | Palmer |
| 6,053,281 | A | | 4/2000 | Murray |

* cited by examiner

*Primary Examiner*—Harry C. Kim
(74) *Attorney, Agent, or Firm*—Larson & Larson, P.A.; James E. Larson

(57) ABSTRACT

Multiple upright adjacent posts spaced apart are each pivotably mounted on a first base plate affixed along an edge of a precipice. The posts have bores through opposed sides and L-shaped brackets mounted on at least one side surface. A triangular brace has a second base plate spaced inwardly from the post. Two arms converging inwardly distal from the second base plate connect ends of the second base plate to the post. The arms pivot with respect to the second base plate. Ropes are threaded through the bores or 2×4's are mounted on the L-brackets or mesh is hung on the L-brackets to create a barrier between the spaced apart posts.

15 Claims, 9 Drawing Sheets

PORTABLE SAFETY BARRIER

This invention relates to safety barriers. More particularly, it refers to a portable safety barrier mounted along a roof edge or other precipice to prevent a person from falling off the roof or precipice.

Workman compensation claims made by employees in the roofing industry are one of the highest in industry. Many of these claims are a direct result of falling from a roof. Safety barriers are customarily not used on roof edges because of the difficulty of mounting them and the high cost of safety barriers together with the difficulty of removing them after a job is completed.

Attempts have been made in the past to construct roof safety barriers to prevent workers from falling off a precipice. One example is set forth in U.S. Pat. No. 4,666,131. An upright post is spaced from an edge of a roof and clamped at a base portion to a rafter. L-shaped guard rail receiving members are movable with respect to the post. Another example is set forth in U.S. Pat. No. 4,909,483. An upright post is supported by hinge arms connected to a base which is located perpendicular to a bottom of the post. Still another example is set forth in U.S. Pat. No. 5,647,451. A roof attachment plate is located perpendicular to the bottom of an upright support beam. An angle adjustment brace connects the support beam to the roof attachment plate. Other guard rails are set forth in U.S. Pat. Nos. 4,787,475; 4,979,725; 5,314,167; 5,431,372; 5,711,398; 5,842,685; 6,038,829; 6,039,150 and 6,053,281.

Although the guard rails in the above described prior art patents serve their intended purpose, they do not provide a simple, easily attachable and detachable safety barrier. Such a safety barrier is needed.

SUMMARY OF THE INVENTION

This invention solves the described problem by providing a simple, inexpensive, easily mountable and demountable safety barrier for use along or on the edge of a roof or other precipice.

The safety barrier has a row of posts, spaced apart, each post pivotably mounted vertically on a first base plate. Each post has multiple spaced apart transverse bores through opposed sides and multiple L-shaped brackets on at least one vertical side. The first base plate is affixed to a surface of a building or bridge abutting an edge overlooking a precipice. A triangular brace supports the post in an upright position. The triangular brace has a second base plate affixed to a surface of the building or bridge inwardly from the edge and the post. A converging pivoting arm connects each end of the second base plate to the post. A safety rope can connect the posts through the transverse bores or 2×4 wood can be mounted on the L-shaped brackets or mesh can be mounted over the same bracket to create a barrier. The second base plate is longitudinally parallel to the rope, wood or mesh to provide the required support for the post.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
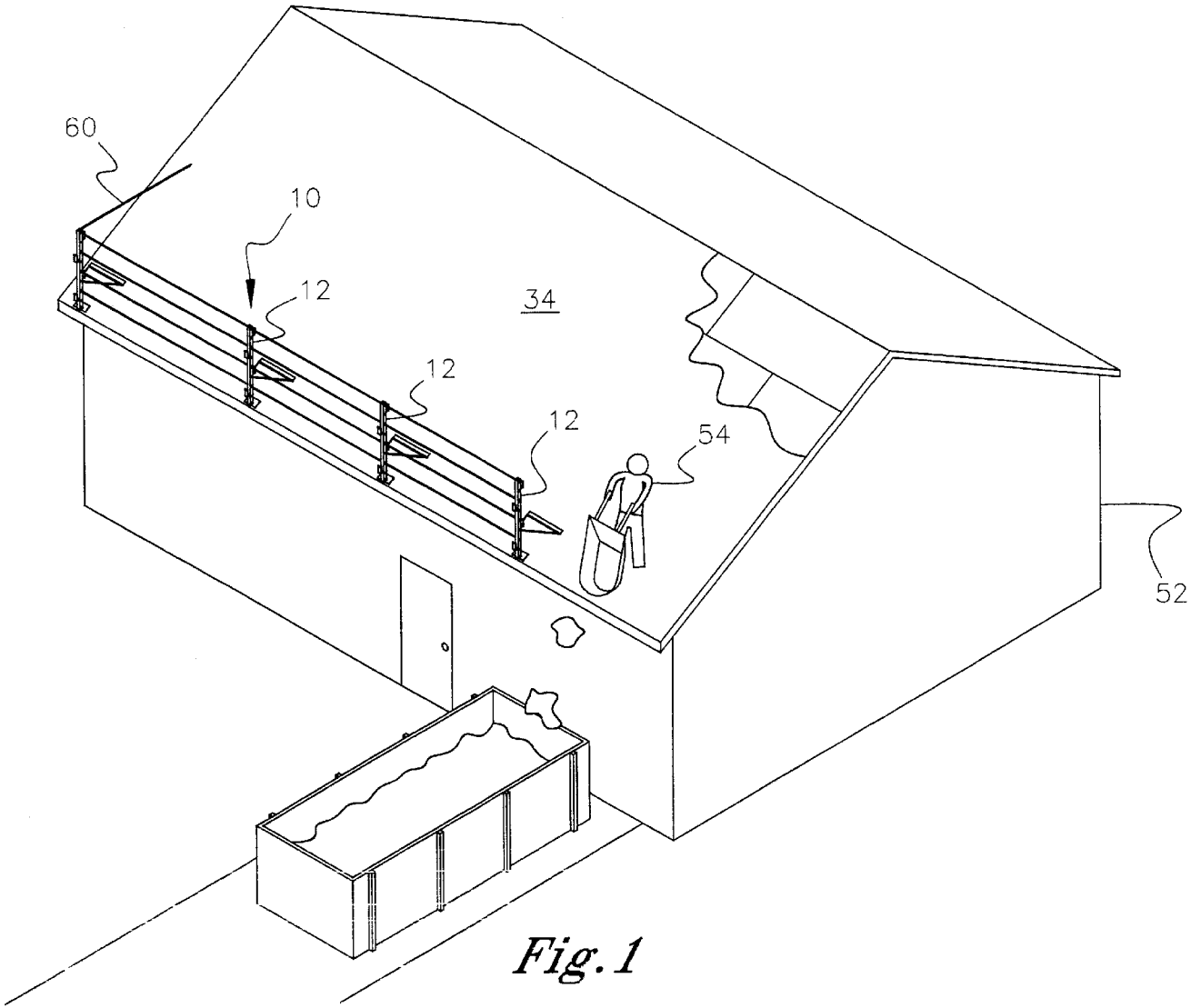
FIG. 1 shows the location of the portable safety barrier invention on a roof.

Throughout the following detailed description, the same reference numerals refer to the same elements in all figures.

Figure 2:
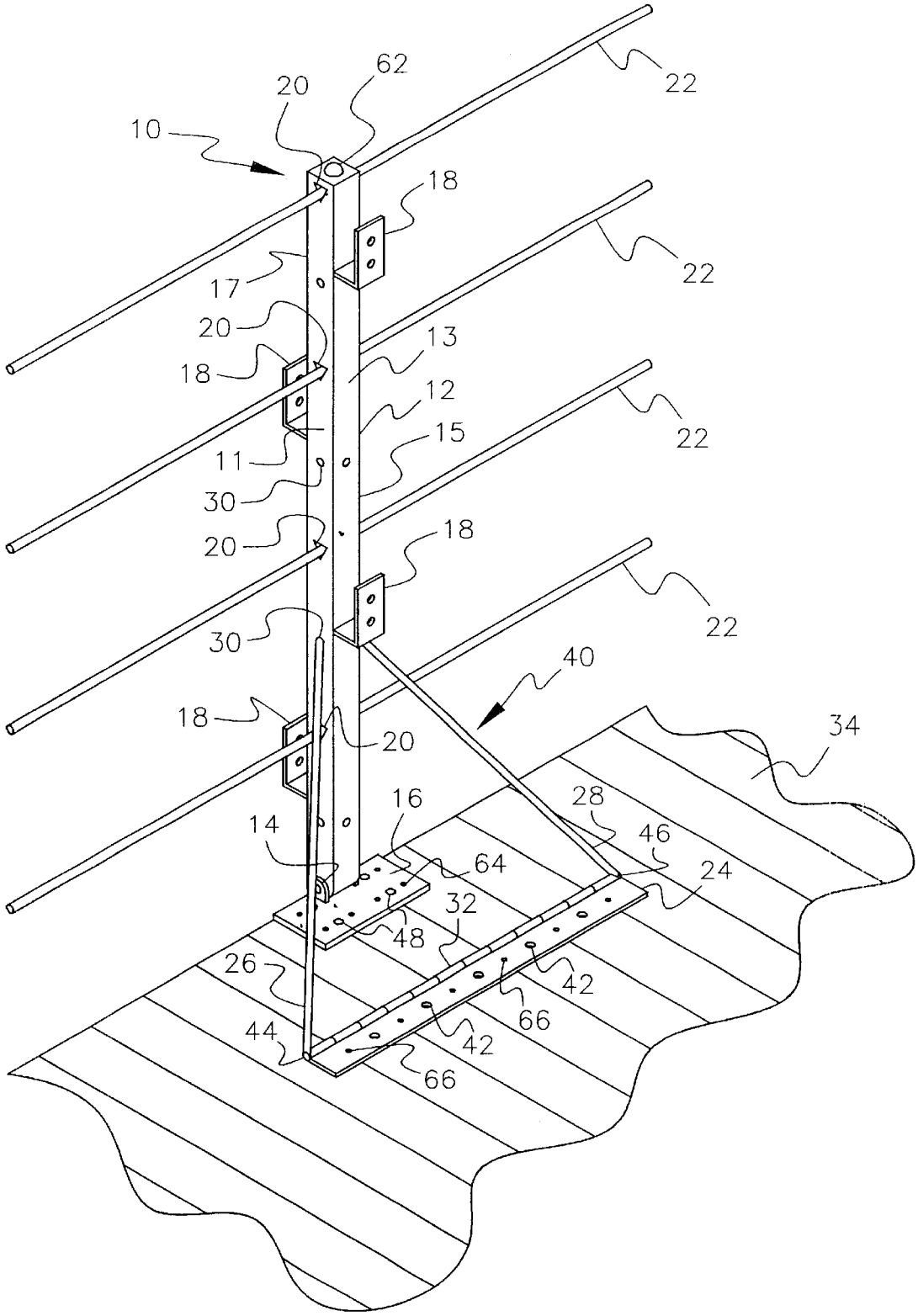
FIG. 2 is a perspective view of the portable safety barrier invention with a rope barrier.
Figure 3:
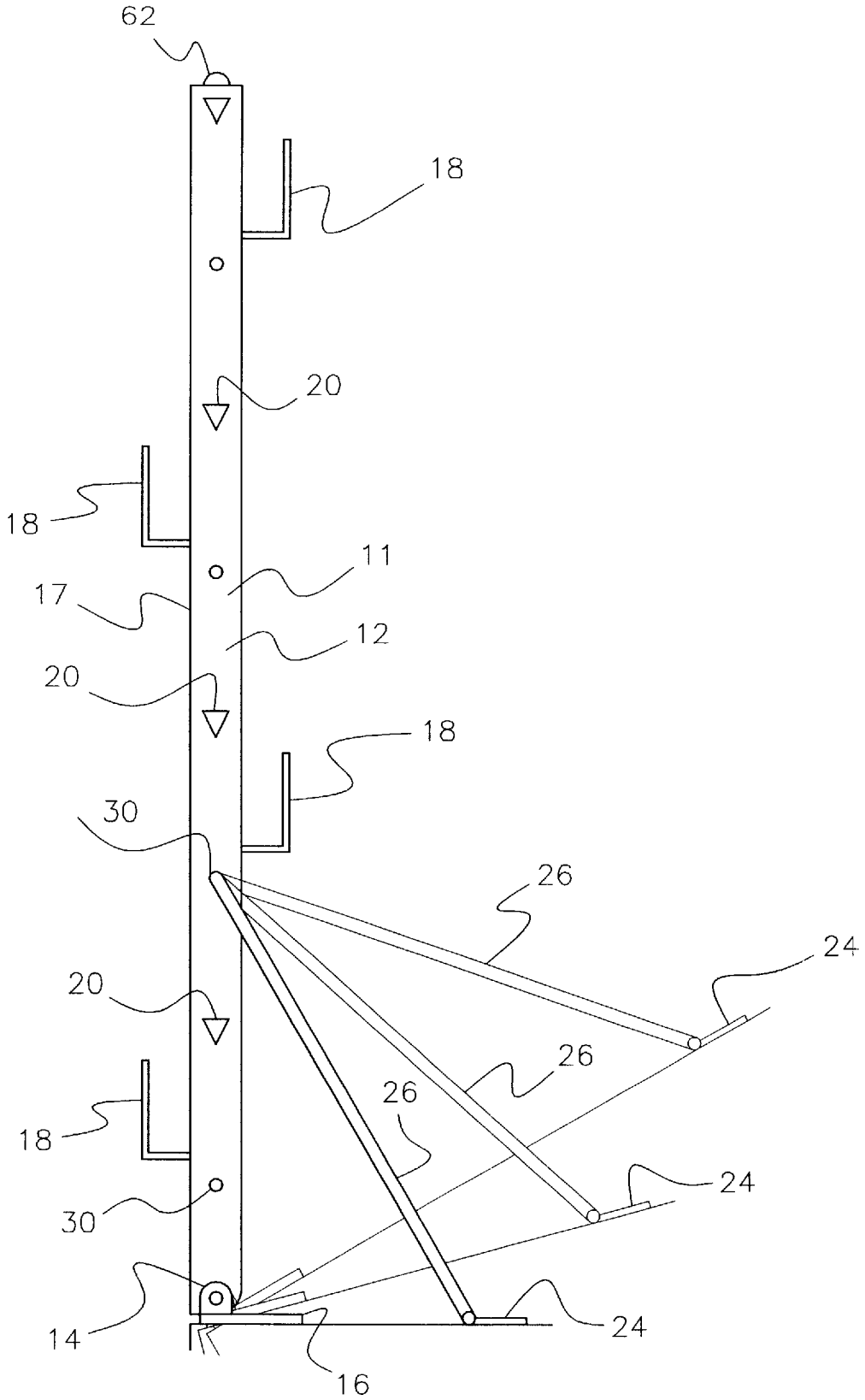
FIG. 3 is a side view of the post and pivoting members of the safety barrier.

Referring first to FIG. 2, the portable safety barrier 10 has an upright post 12 having four side surfaces 11, 13, 15, and 17. The base of post 12 is pivotably mounted by pivot joint 14 on a first base plate 16.

Figure 4:
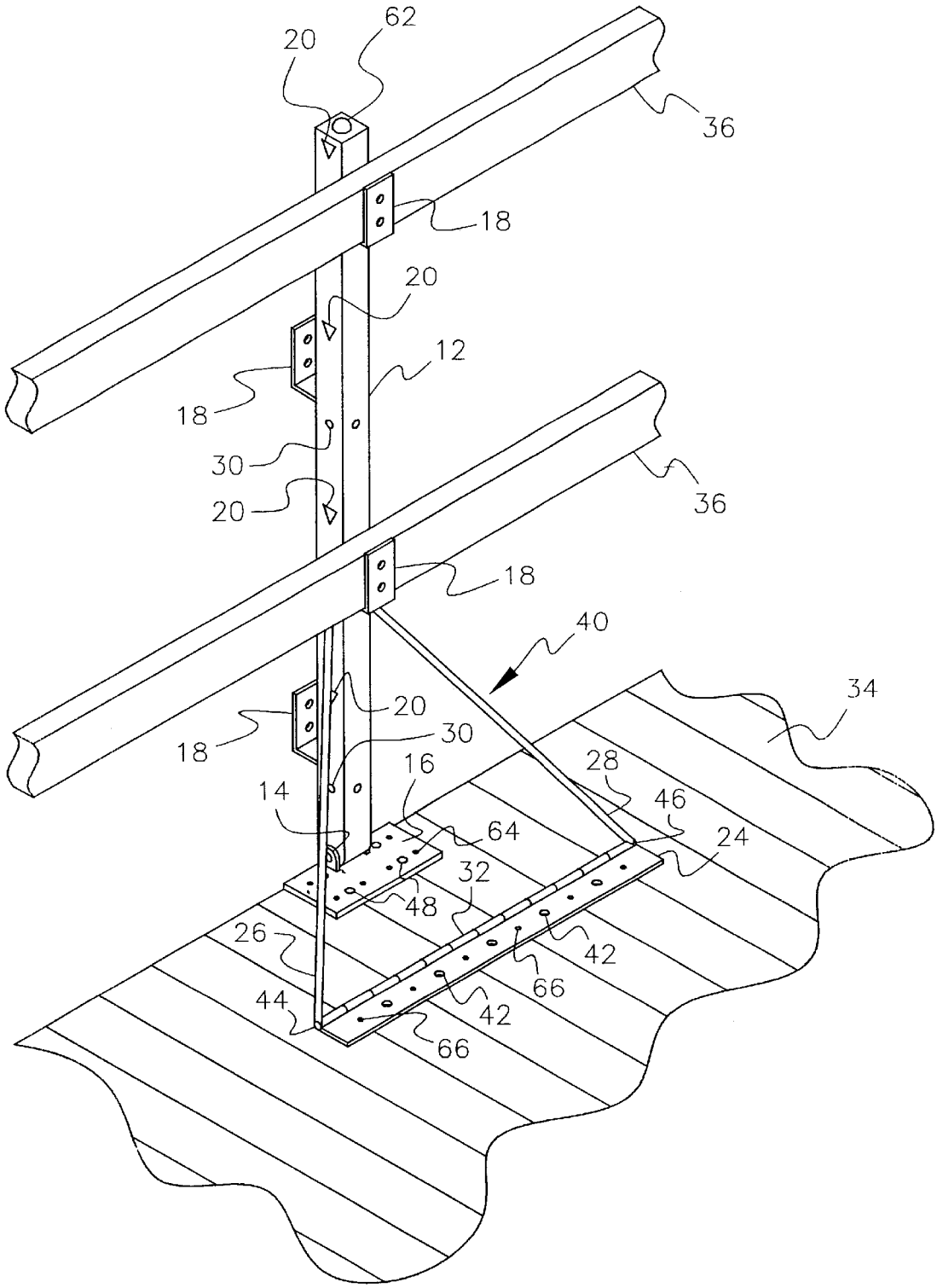
FIG. 4 is a perspective view of the portable safety barrier invention with a 2×4 wood barrier.

Post 12 has bores 20 through side surfaces 11 and 15 through which a rope 22 is threaded to connect multiple spaced apart posts 12 to create a barrier. Each post 12 also has multiple L-shaped brackets 18 affixed such as by welding one above the other on side surfaces 13 and 17. Two by four lumber 36 can be placed within brackets 18 to create a barrier as seen in FIG. 4. Alternatively, an orange safety mesh 38 can be hung on brackets 18 to create a barrier as seen in FIG. 5.

Figure 5:
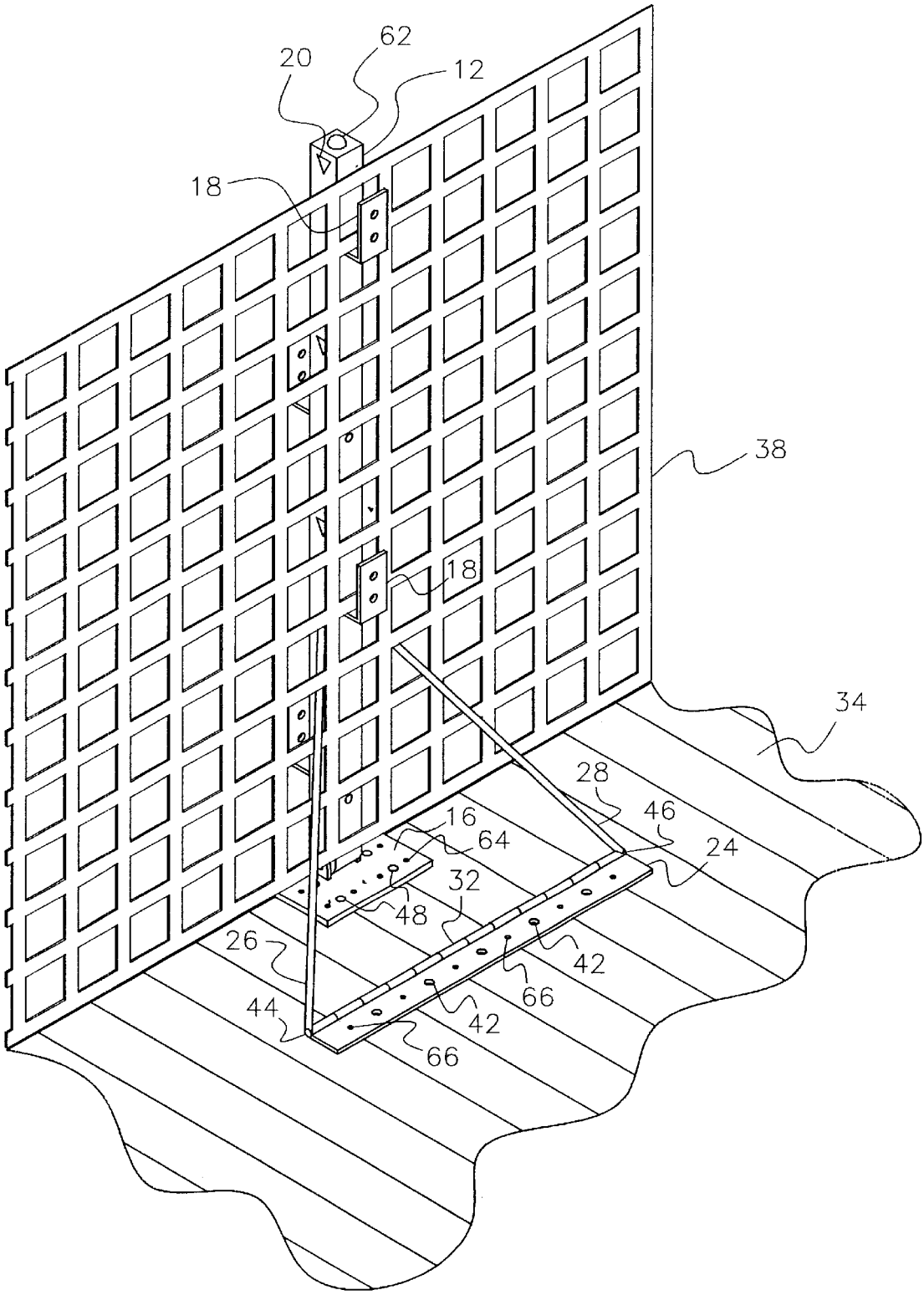
FIG. 5 is a perspective view of the portable safety barrier invention with a safety mesh barrier.

A triangular brace 40 has a second base plate 24 spaced apart inwardly from the roof edge and from the vertical post 12 as seen in FIGS. 2, 4 and 5. A first 26 and second 28 side arm connect a first 44 and second 46 end, respectively of the second base plate 24 to the vertical post 12. Hinge 32 allows the arms 26 and 28 to move with respect to base plate 24. The side arms 26 and 28 converge from the second base plate 24 to sides 11 and 15, respectively of post 12. Holes 30 accommodate the top ends of the side arms 26 and 28 on post 12. Bolt holes 42 can be used to secure base plate 24 to surfaces 34. Alternatively, holes 66 on the second pivotable base plate 24 accommodate nails or screws which are used to firmly attach base plate 24 to a wood, asphalt or concrete surface. In like manner, bolt holes 48 can be used to secure base plate 16 to surface 34. Alternatively, holes 64 on first base plate 16 accommodate nails or screws to firmly attach base plate 16 to a wood, asphalt or concrete surface.

Figure 6:
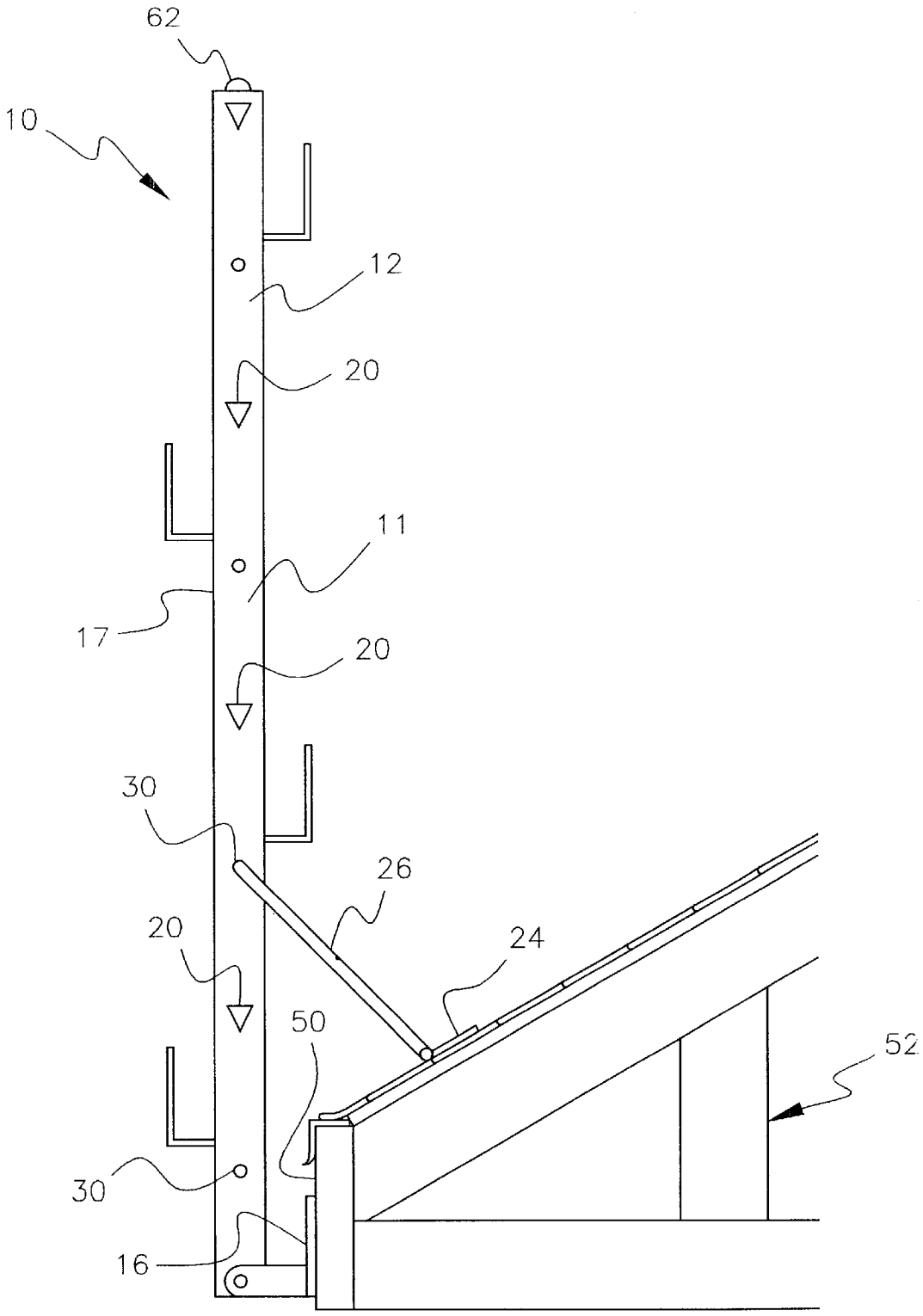
FIG. 6 is a side view of the safety barrier post base attached to a vertical portion of a roof.
Figure 7:
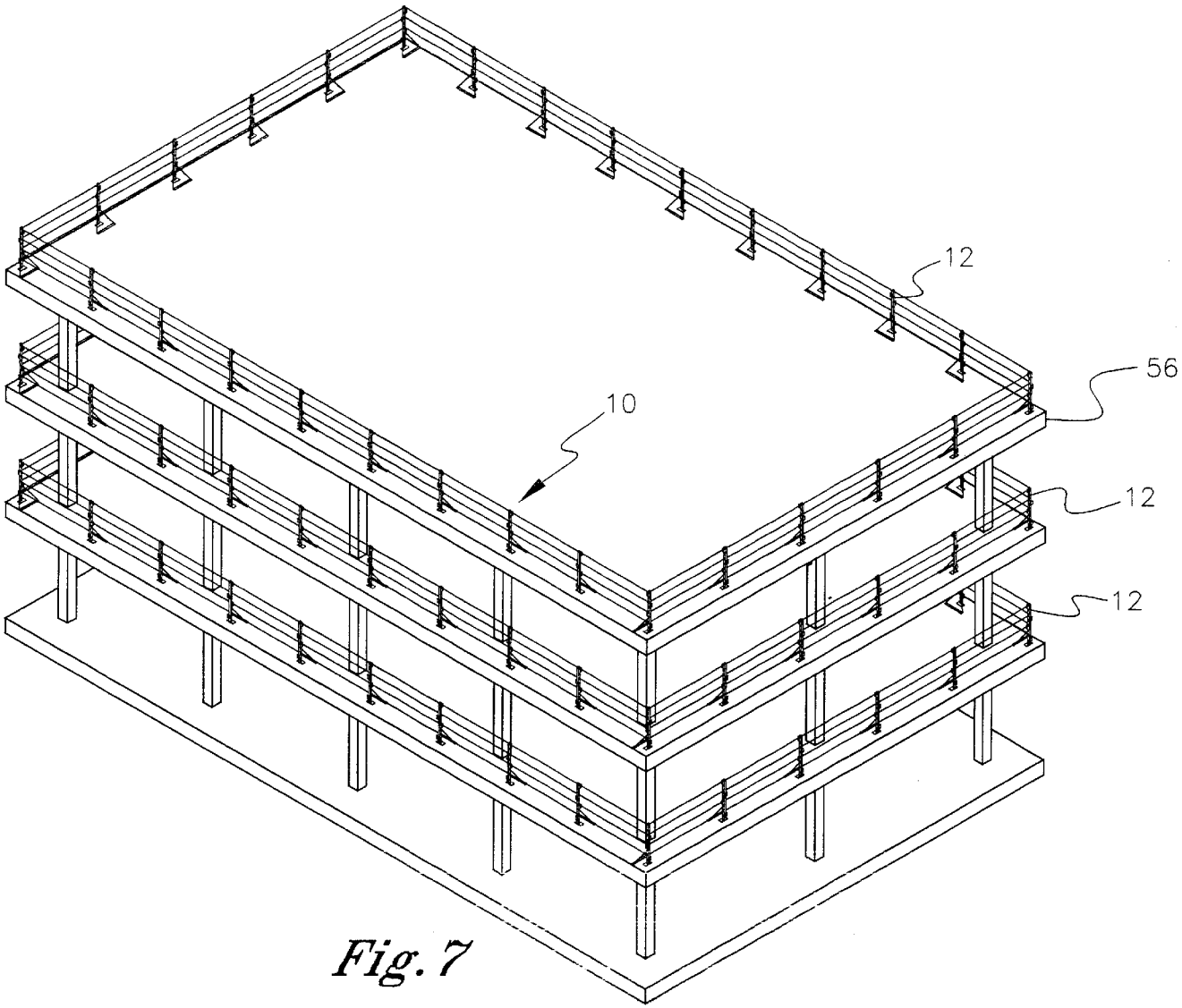
FIG. 7 shows the location of the portable safety barrier invention on a building under construction.
Figure 8:
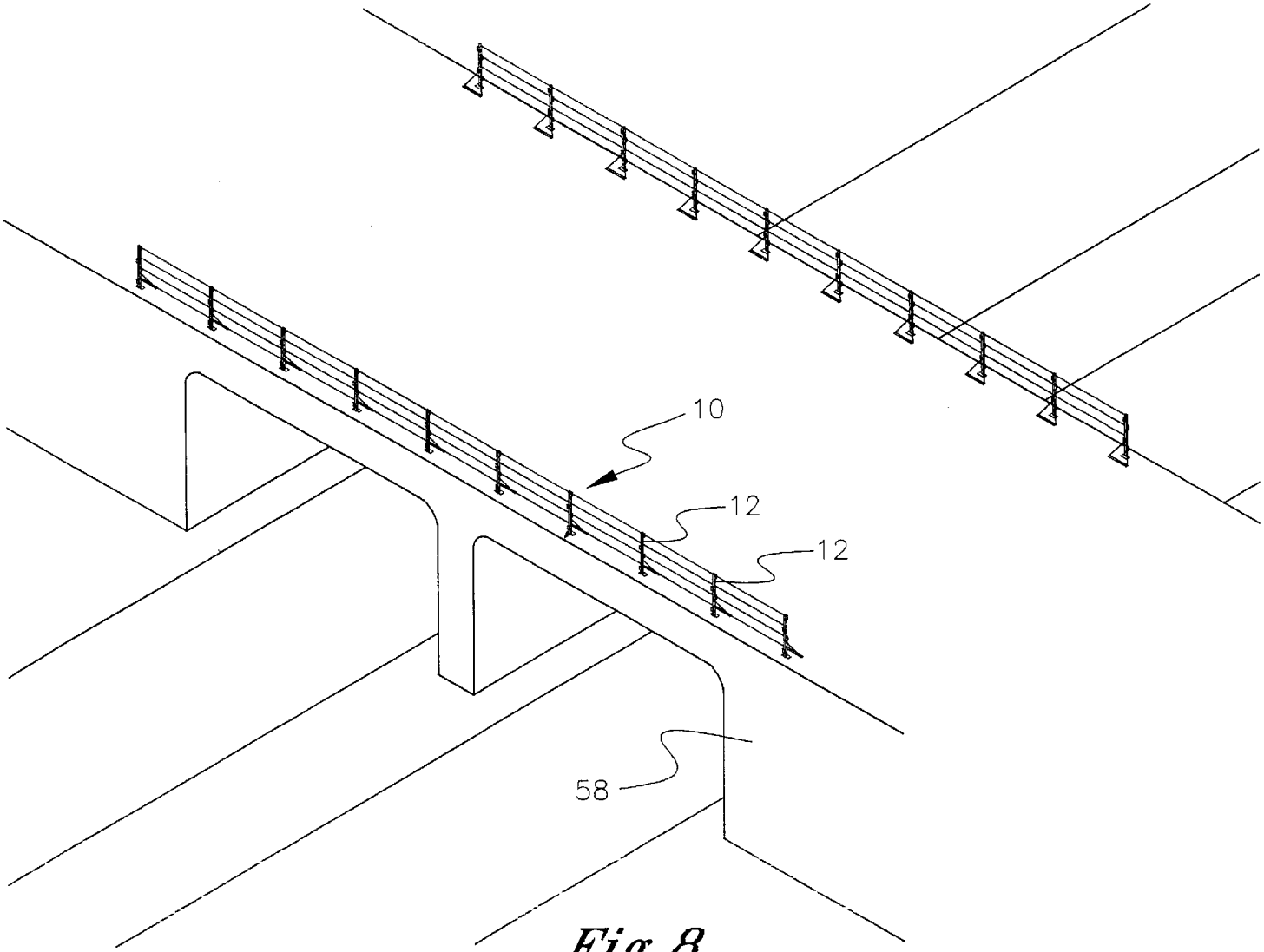
FIG. 8 shows the location of the portable safety barrier invention on a bridge under construction.
Figure 9:
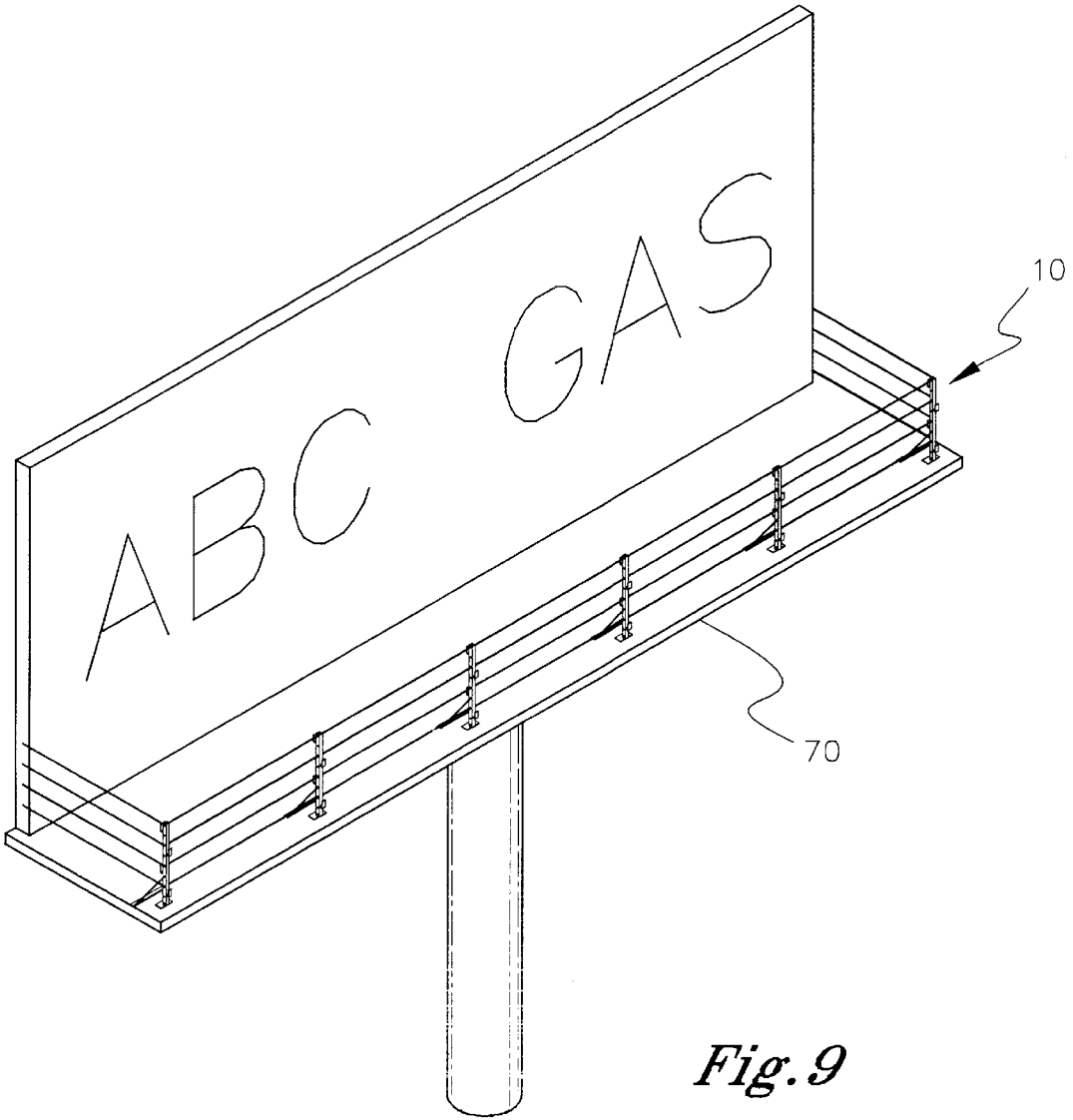
FIG. 9 shows the location of the portable safety barrier invention on a sign platform.

As seen in FIG. 6, the first base plate 16 can be affixed to a side surface 50 of a building 52 so that post 12 is spaced from building side surface 50, but the second base plate 24 remains attached to roof surface 34. In this configuration, the attachments of arms 26 and 28 are in a higher spacer hole 30 along post 12.

As can be seen in all of FIGS. 1, and 7–9, the safety barriers 10 protects a worker 54 from falling off a roof or other high precipice at the edge of a building under construction 56, on a bridge 58 or a sign platform 70.

As can be seen in FIG. 1, an end 60 of rope 22 can be affixed to roof surface 34 or the ends of the rope 22 can be tied off at post 12. A level 62 is alternatively positioned in top of post 12 to maintain an upright position prior to securing triangular brace 40 to the roof surface 34.

The post 12 can be made of wood, steel or high strength aluminum. If the post 12 is made of wood, then L-shaped bracket 18 requires a flange with nail holes to secure the bracket 18 to the wood post.

The above description has described specific structural details embodying the invention. However, it will be within one having skill in the art to make modification without departing from the spirit and scope of the underlying inventive concept.

Having thus described the invention, what is claimed and desired to be secured by Letters Patent is:

1. A portable safety barrier comprising:

multiple upright posts, each post having four vertical sides, each post pivotably mounted vertically on a first base plate, each post having multiple spaced apart transverse bores through opposed sides and multiple L-shaped brackets mounted on a vertical side free of the transverse bores;

a triangular brace having a second baseplate spaced apart from each upright post with a first and second side arm connecting a first and second end of the second base plate to the upright post, the second baseplate extending generally parallel to the transverse bores, the side arms converging from the second base plate toward opposing sides of the upright post and pivoting with respect to the second base plate;

the first base plate affixed to a surface region abutting a precipice and the second base plate affixed a predetermined distance inwardly from the precipice; and means for creating a barrier connecting each post so that a person cannot fall over the precipice.

2. The portable safety barrier according to claim 1 wherein the means for creating a barrier is a rope through the transverse bores joining the upright adjacent posts.

3. The portable safety barrier according to claim 1 wherein the means for creating a barrier is a two by four wood beam positioned inboard on each L-shaped bracket on adjacent posts to join the upright adjacent posts.

4. The portable safety barrier according to claim 1 wherein the means for creating a barrier is a mesh material draped over the L-shaped bracket on adjacent posts to join the upright adjacent posts.

5. The portable safety barrier according to claim 1 wherein the posts are made from high strength aluminum.

6. The portable safety barrier according to claim 1 wherein the posts are made from steel.

7. A portable safety barrier having multiple upright spaced apart posts connected by a safety material along an edge of a precipice, the posts each comprising (a) four vertical sides, the post pivotably mounted vertically on a first base plate affixed to a surface, (b) multiple vertically spaced apart transverse bores through two opposed sides, (c) multiple vertically spaced apart L-shaped brackets mounted on a vertical side free of the transverse bores, (d) a triangular brace supporting the post, the triangular brace having a second base plate spaced apart from the edge of the precipice and the first base plate, the second base plate affixed to a surface, the second base plate having ends defining a longitudinal member positioned parallel to the transverse bores, an arm connecting each end of the second base plate to the opposed side of the post, the arms converging from the second base plate end to the post side and the arms pivoting with respect to the second base plate.

8. A portable safety barrier according to claim 7 wherein the safety material is rope threaded through the transverse bores between adjacent upright posts.

9. A portable safety barrier according to claim 7 wherein the safety material is a two by four joining L-shaped brackets on corresponding adjacent posts.

10. A portable safety barrier according to claim 7 wherein the safety material is a mesh joining L-shaped brackets on corresponding adjacent posts.

11. A portable safety barrier according to claim 7 wherein the first base plate is affixed to a surface under the post.

12. A portable safety barrier according to claim 7 wherein the first base plate is affixed to a side surface of a building so that the post is spaced from the building side surface.

13. A portable safety barrier according to claim 7 wherein the second base plate is affixed to a roof surface.

14. A portable safety barrier according to claim 7 wherein the second base plate is affixed to a bridge surface.

15. A portable safety barrier according to claim 7 wherein the second base plate is affixed to a sign platform surface.

* * * * *